US007462013B2

(12) United States Patent
Iwasaki et al.

(10) Patent No.: US 7,462,013 B2
(45) Date of Patent: Dec. 9, 2008

(54) BLOWER WITHOUT FREEZING LOCK PHENOMENON AND HEAT EXCHANGING DEVICE COMPRISING THE BLOWER

(75) Inventors: Takahiro Iwasaki, Kariya (JP); Shinichi Oda, Okazaki (JP)

(73) Assignee: Denso Corporation, Kariya (JP)

( * ) Notice: Subject to any disclaimer, the term of this patent is extended or adjusted under 35 U.S.C. 154(b) by 135 days.

(21) Appl. No.: 11/366,719

(22) Filed: Mar. 2, 2006

(65) Prior Publication Data

US 2006/0147302 A1 Jul. 6, 2006

Related U.S. Application Data

(63) Continuation of application No. PCT/JP2004/014008, filed on Sep. 17, 2004.

(30) Foreign Application Priority Data

Sep. 19, 2003 (JP) ..... 2003-328057

(51) Int. Cl.
*F01B 31/18* (2006.01)

(52) U.S. Cl. ..... 415/169.2; 415/169.4

(58) Field of Classification Search ..... 415/169.1, 415/169.2, 169.4, 121.2
See application file for complete search history.

(56) References Cited

U.S. PATENT DOCUMENTS 5,520,513 A 5/1996 Kuroki et al.

FOREIGN PATENT DOCUMENTS

| | | |
|---|---|---|
| JP | 62-10297 U | 1/1987 |
| JP | 2000-240456 A | 9/2000 |
| JP | 2002-106500 | 4/2002 |
| JP | 2002-106500 A | 4/2002 |

(Continued)

OTHER PUBLICATIONS

Microfilm of the specification and drawings annexed to the request of Japanese Utility Model Application No. 101464/1985 (Laid-open No. 10297/1987) (Toyota Motor Corp.), Jan. 22, 1987—corresponds to JP-62-10297-U (listed above).

(Continued)

*Primary Examiner*—Edward Look
*Assistant Examiner*—Dwayne J White
(74) *Attorney, Agent, or Firm*—Harness, Dickey & Pierce, PLC

(57) ABSTRACT

The discharge water means (1*m*) is provided within an area equal to or more than an area of the shroud extending to 20 degree points in both directions from a center that is a lowest portion of the ring portion (1*h*). Due to this, if water drops adhered to the surface of the blade wheel (1*a*) and the shroud (1*c*) are collected at the lower side thereof due to gravity, it is possible to readily discharge the water. As a result, as it is possible to prevent the water drops from being stored in a clearance between the blade wheel (1*a*) and the shroud (1*c*), even when the temperature of the atmosphere is low in a winter season or the like, it is possible to prevent a freezing lock phenomenon from occurring.

11 Claims, 4 Drawing Sheets

FOREIGN PATENT DOCUMENTS

| | | |
|---|---|---|
| KR | 1991-0017084 | 11/1991 |
| KR | 01-40195 | 3/1998 |
| KR | 2002-0081716 | 10/2002 |
| KR | 2003-0077324 | 10/2003 |
| KR | 2003-0085333 | 11/2003 |
| KR | 10-0476075 | 3/2005 |

OTHER PUBLICATIONS

Office Action from corresponding Chinese Patent Application No. 200480026914 dated Dec. 7, 2007 with English translation.

Office action dated Aug. 19, 2008 in Japanese Application No. 2003-328057 with English translation thereof.

(A)

(B)

BLOWER WITHOUT FREEZING LOCK PHENOMENON AND HEAT EXCHANGING DEVICE COMPRISING THE BLOWER

CROSS-REFERENCE TO RELATED APPLICATION

This application is a continuation application and is based upon PCT/JP2004/014008, filed on Sep. 17, 2004.

BACKGROUND OF THE INVENTION

1. Field of the Invention

The present invention relates to a blower and it is effective when applied to a blower which supplies cooling air to a radiator and a condenser for a vehicle or the like.

2. Description of the Related Art

A blower for supplying cooling air to a radiator and a condenser for a vehicle comprises an axial flow type blade wheel for producing an air flow, an electric motor for rotating the blade wheel, a shroud which surrounds and covers the blade wheel so as to prevent air discharged from the blade wheel from being sucked again by the blade wheel, and the like.

In order to prevent the air discharged from the blade wheel from being sucked again by the blade wheel without fail, it is preferable to decrease the size of the gap between the ends of the blades of the blade wheel and the inner wall of the shroud to as small as possible.

As a heat exchanger, such as a radiator or a condenser for a vehicle, or the like, takes outside air used for cooling at higher flow rate, it is usually mounted on a front end of the vehicle, so that the blower is exposed to rain, snow, or the like together with the cooling outside air and the blade wheel and the shroud tend to be wetted with water.

After that, if the blower is stopped for a long time at night and the vehicle is not operated, water drops adhered on the surfaces of the blade wheel and the shroud fall down to be gathered and accumulated at a lower side due to gravity thereof. When the temperature of the atmosphere is low in a winter season or the like, the accumulated water drops are frozen so as to connect the top ends of the blades with the shroud. As a result, there is a problem that the blade wheel cannot rotate (hereinafter, this problem will be referred as a freezing lock).

Especially, in a case in which an annular ring, for connecting the blade top ends of the blade wheel, is installed on the blade top ends of the blade wheel, the ring and the shroud are connected by freezing along a relatively wide range of the shroud so that the lower end side of the shroud becomes the center of the range. In such a case, the freezing lock presents a troublesome problem.

SUMMARY OF THE INVENTION

The present invention has been developed with above-mentioned problems being taken into consideration, and the first object of the present invention is to provide a novel blower different from that in a prior art. The second object of the present invention is to prevent a freezing lock phenomenon from occurring in advance.

In order to attain the above-mentioned objects, a first aspect according to the present invention is characterized in that, a blower comprises: a blade wheel (1*a*) for producing an air flow; a driving source (1*b*) for rotating the blade wheel (1*a*); and a shroud (1*c*) surrounding an outer circumference of the blade wheel (1*a*) so as to cover it, and in that a discharge water means (1*m*, 1*n*) for discharging water stored between the shroud (1*c*) and the blade wheel (1*a*) is provided at a lower side of the shroud (1*c*).

Due to this, if water drops adhered to the surfaces of the blade wheel (1*a*) and the shroud (1*c*) are collected at the lower side thereof due to gravity thereof, it is possible to readily discharge the water drops.

As a result, as it is possible to prevent the water drops from being stored in a gap between the blade wheel (1*a*) and the shroud (1*c*), even when the temperature of the atmosphere is low in a winter season or the like, it is possible to prevent a freezing lock phenomenon from occurring in advance.

A second aspect according to the present invention is characterized in that, the blade wheel (1*a*) is an axial flow type fan in which air flows through in an axial direction of a rotating shaft of the blade wheel (1*a*), the axial direction is substantially parallel to a horizontal direction, and in that the discharge water means (1*m*, 1*n*) is provided on an annular ring portion (1*h*) of the shroud (1*c*) surrounding an outer circumferential portion of the blade wheel (1*a*).

A third aspect according to the present invention is characterized in that the discharge water means (1*m*) comprises a through-hole penetrating through the ring portion (1*h*).

A fourth aspect according to the present invention is characterized in that the discharge water means (1*n*) comprises an inclined surface inclined with respect to a horizontal plane.

A fifth aspect according to the present invention is characterized in that the discharge water means (1*m*, 1*n*) is provided within a specific area in which a lowest portion of the ring portion (1*h*) is a center thereof.

In this configuration, even if the blower is held in an inclined state, it is possible to discharge the water drops without fail, so that it is possible to certainly prevent a freezing lock phenomenon from occurring.

A sixth aspect according to the present invention is characterized in that the discharge water means (1*m*, 1*n*) is provided within an area equal to or more than an area of the lower side of the shroud extending to 20 degree points along the blade circumference in both directions (total 40 degree area) from a center which is a lowest portion of the ring portion (1*h*).

In this configuration, even if the blower is held in an inclined state, it is possible to discharge the water drops without fail, so that it is possible to certainly prevent a freezing lock phenomenon from occurring.

A seventh aspect according to the present invention is characterized in that the discharge water means (1*m*, 1*n*) is provided within an area equal to or more than an area of the lower side of the shroud extending to 10 degree points along the blade circumference in both directions (total 20 degree area) from a center which is a lowest portion of the ring portion (1*h*).

In this configuration, even if the blower is held in an inclined state, it is possible to discharge the water drops without fail, so that it is possible to certainly prevent a freezing lock phenomenon from occurring.

An eighth aspect according to the present invention is characterized in that a ring (1*g*) formed in an annular shape so as to connect the top ends of the blades (1*e*) of the blade wheel (1*a*) is provided on the blades (1*e*).

A ninth aspect according to the present invention is characterized in that the discharge water means (1*m*, 1*n*) is provided on a step portion (1*k*) of the ring portion (1*h*) having a step-like shape.

When the shroud (1*c*), for example, is formed of a resin, it is advantageous in productivity that the shroud (1*c*) is taken out from a cavity (a space in the molds) formed between the two molds by moving at least one of the two molds in an axial direction of the ring portion (1*h*).

At this time, as a plane intersecting the mold moving direction in which the mold is moved (taken out), that is, the axial direction of the ring portion (1*h*), is formed in the step portion (1*k*), when the discharging water means (1*m*, 1*n*) is provided in the step portion (1*k*), as in the present invention, it is possible to easily provide the discharge water means (1*m*, 1*n*) without additionally providing a specific slide mold.

As a result, it is possible to provide an inexpensive mold for manufacturing the shroud 1*c* so that it is possible to reduce the cost of equipment investment and, therefore, it is possible to prevent a freezing lock phenomenon from occurring while restricting the increase of the manufacturing cost of the shroud 1*c*.

A heat exchanging device for a vehicle of a tenth aspect according to the present invention is characterized in that it comprises: a heat exchanger (2) mounted on a front end of the vehicle for effecting heat exchange with air; and a blower as set forth in any one of claims 1 to 9, for supplying air to the heat exchanger (2).

The symbols in the parenthesis attached to each means described above indicate a correspondence with a specific means in the embodiments to be described later.

The present invention may be more fully understood from the description of the preferred embodiments of the invention set forth below, together with the accompanying drawings.

DESCRIPTION OF THE PREFERRED EMBODIMENTS

First Embodiment

Figure 1:
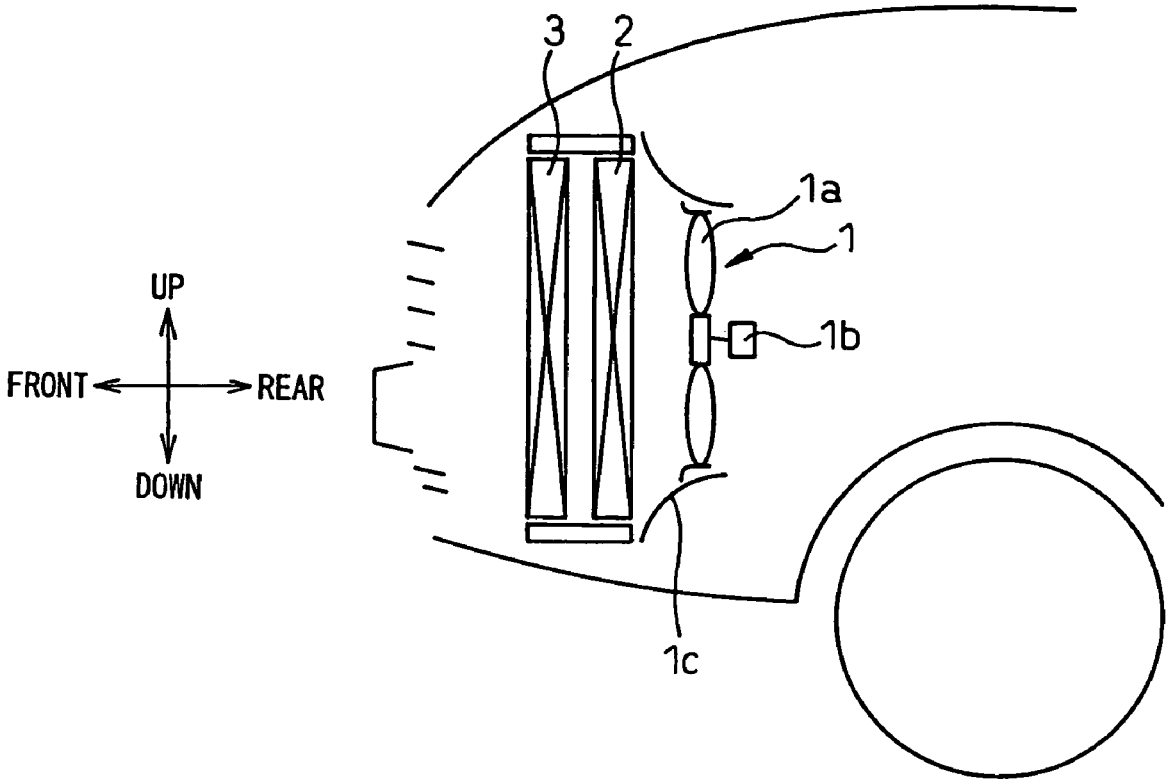
FIG. 1 is a schematic drawing of a blower 1 according to embodiments of the present invention, showing the blower mounted on a vehicle.
Figure 2:
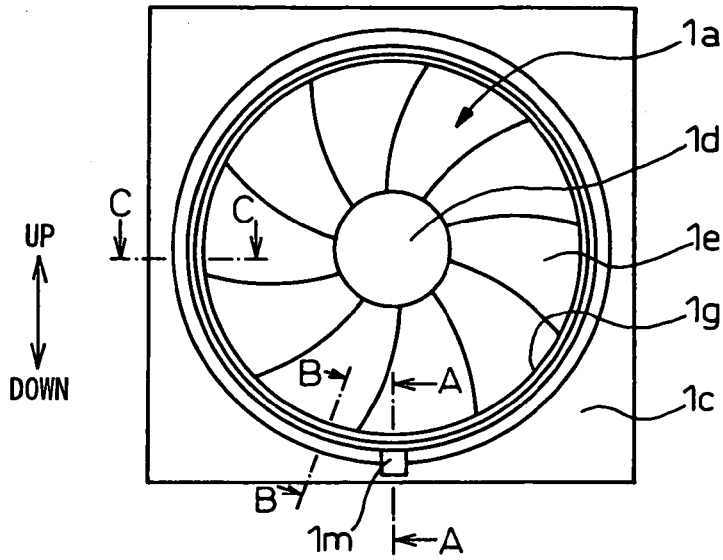
FIG. 2 is a drawing explaining the characteristics of a blower 1 according to a first embodiment of the present invention.
Figure 2:
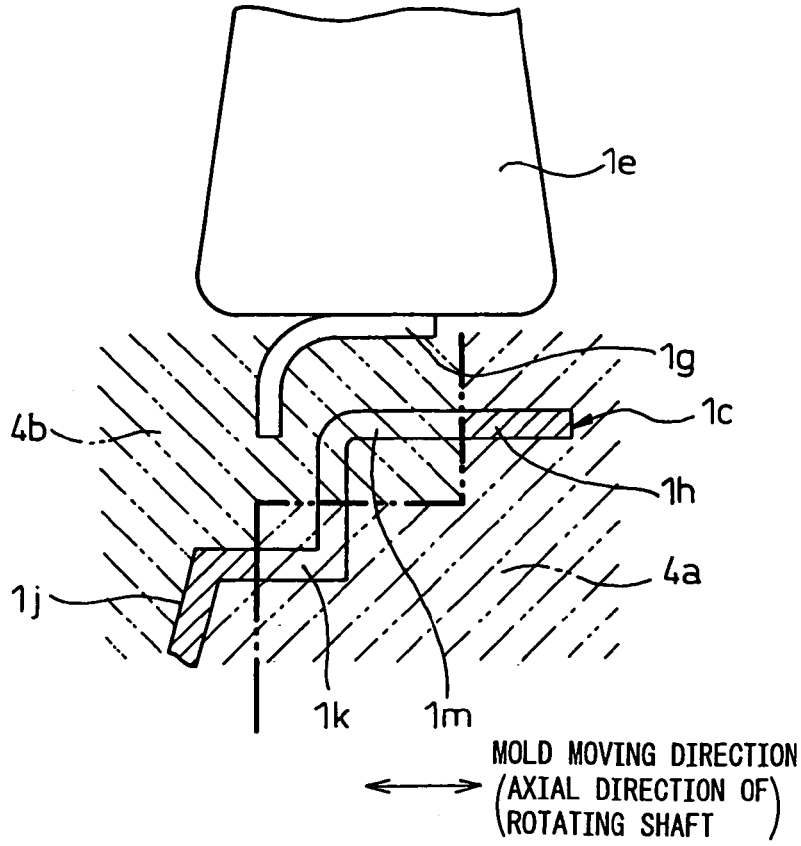

In a first embodiment, a blower according to the present invention is applied to a blower for supplying cooling air to a heat exchanger such as a radiator or a condenser for a vehicle, or the like. FIG. 1 is a schematic view showing a mounting state in which the blower 1 according to the present embodiment is mounted in a vehicle. FIG. 2(A) is a front view of the blower 1 when the blower 1 is viewed from an upstream side of a cooling air flow. FIG. 2(B) is a sectional view taken along a line A-A in FIG. 2(A).

Further, in a heat exchanger for a vehicle according to the present embodiment, as shown in FIG. 1, a radiator 2 and a condenser 3 are mounted at the upstream side of the cooling air flow of the blower 1 and, at the same time, a heat exchanging device for a vehicle comprising a blower 1, a radiator 2, a condenser 3, etc. is mounted at the front end section of the vehicle.

The radiator 2 is a heat exchanger which cools engine cooling water by effecting heat exchange between outside air and the engine cooling water circulating in an engine (an internal combustion engine) that acts as a driving source for driving the vehicle and the condenser 3 is a heat radiator for an air conditioner for a vehicle (a vapor compression type refrigerator).

The outer circumferences of the radiator 2 and the condenser 3 are covered by a carrier so that a ventilation duct structure of the cooling air from the condenser 3 to the radiator 2 is constructed. The carrier is a member on which the heat exchangers, such as a radiator, and the front lights (head lights) are installed and which is called as a radiator support or a front end panel in some references.

The blower 1 comprises a blade wheel 1*a* for producing an air flow by the rotation of the blade wheel 1*a*, an electric motor 1*b* acting as a driving source for rotating the blade wheel 1*a*, a shroud 1*c* which surrounds and covers the outer circumferential side of the blade wheel 1*a* so as to prevent air discharged from the blade wheel 1*a* from being sucked again by the blade wheel 1*a*, and the like.

As the blower 1 according to the present embodiment, an axial flow type fan (refer to JIS (Japanese industrial standard) B 0132, NO. 1012 or the like) in which air flows through the blade wheel 1*a* in an axial direction of the rotating shaft thereof is employed. In this embodiment, the blower 1 is secured to the radiator 2 or the carrier via the shroud 1*c* so that the rotating shaft of the blade wheel 1*a* is set to be substantially horizontal.

In addition, the blade wheel 1*a*, as shown in FIG. 2(A), comprises a boss portion 1*d* fixed to the rotating shaft of the electric motor 1*b*, a plurality of blades 1*e* radially extending from the boss portion 1*d*, a ring 1*g* annually formed so as to connect the top ends of the blades 1*e*, and the like. In this embodiment, the boss portion 1*d*, the blades 1*e* and the ring 1*g* are integrally formed of a resin.

In addition, the shroud 1*c*, as shown in FIG. 2(B), comprises an annular ring portion 1*h* surrounding the outer circumferential portion of the blade wheel 1*a*, that is, the top end side of the blades 1*e*, a horn portion 1*j* expanding like a horn to connect the ring portion 1*h* and the outer circumferential portion of the shroud 1*c*, and the like. A step portion 1*k* having a step-like shape is provided at a joining portion between the ring portion 1*h* and the horn portion 1*j*.

The ring 1*g*, which reduces noise by preventing air from flowing through a gap between the top ends of the blades 1*e* and the ring portion 1*h* while preventing the decrease of the supply air flow rate, is formed to have a substantially L shape so that it forms a shape similar to the step-like shape joining the ring portion 1*h* and the horn portion 1*j*.

On the area of the lower end side (lowest portion) of the ring portion 1*h* opposing to the ring 1*g*, as shown in FIG. 2(A), a discharge port 1*m* which acts as a discharging water means for discharging water stored between the shroud 1*c* and the blade wheel 1*a* is provided. The discharge port 1*m* comprises a through-hole penetrating through the step portion 1*k* in a vertical direction.

The features of the blower 1 according to the present embodiment will be described below.

In this embodiment, as the discharge port 1*m* is provided at the lower end side of the shroud 1*c*, even if water drops adhered to the surfaces of the blade wheel 1*a* and the shroud 1*c* (especially, the ring portion 1*h*) gather to the lower side thereof due to gravity, it is possible to readily discharge the water drops.

Accordingly, as it is possible to prevent water drops from being stored in the gap between the blade wheel 1*a* and the ring portion 1*h* (the shroud 1*c*), it is possible to prevent, in advance, a freezing lock phenomenon from occurring even when the temperature of the atmosphere is low in a winter season or the like.

In this embodiment, the discharge ports 1*m* are provided within an area equal to or more than an area of the shroud extending to 20 degree points along the blade circumference in both directions (total 40 degree area) from the center which is the lowest portion of the shroud 1*c* when the vehicle stops in a horizontal state and, therefore, even when the vehicle stops in an inclined state, it is possible to discharge the water drops without fail.

In the shroud 1*c* according to the present embodiment, the ring portion 1*h*, the step portion 1*k* and the horn portion 1*j* are integrally formed of a resin and the mold for molding the shroud 1*c* (the part shown in FIG. 2(B) by the alternate long and two short dashes line) is formed by a first mold 4*a* and a second mold 4*b* having a mold dividing surface indicated by the thick alternate long and two short dashes line in FIG. 2(B).

By moving at least one of the two molds in an axial direction of the ring portion 1*h*, the shroud 1*c* can be taken out from a cavity (molding space) formed between the two molds.

At this time, it is necessary for the discharge port 1*m* to be a through-hole penetrating in a vertical direction in a state in which the shroud 1*c* is mounted on the vehicle. However, as the vertical direction in a state in which the shroud 1*c* is mounted on the vehicle corresponds to the radial direction of the ring portion 1*h*, the direction in which the mold is taken out does not coincide with the vertical direction in a state in which the shroud 1*c* is mounted on the vehicle.

However, as the step portion 1*k* connecting the ring portion 1*h* and the horn portion 1*j* comprises a surface intersecting the direction in which the mold is taken out, that is, the axial direction of the rotating shaft, if the discharge port 1*m* is provided on the step portion 1*k* as in the present embodiment, a through-hole penetrating in the direction in which the mold is taken out, that is, the axial direction of the rotating shaft, can be easily formed without additionally providing a special sliding type mold.

As a result, it is possible to provide an inexpensive mold for manufacturing the shroud 1*c* so that it is possible to reduce the cost of equipment investment and, therefore, it is possible to prevent a freezing lock phenomenon from occurring while restricting the increase of the manufacturing cost of the shroud 1*c*.

Second Embodiment

Figure 3:
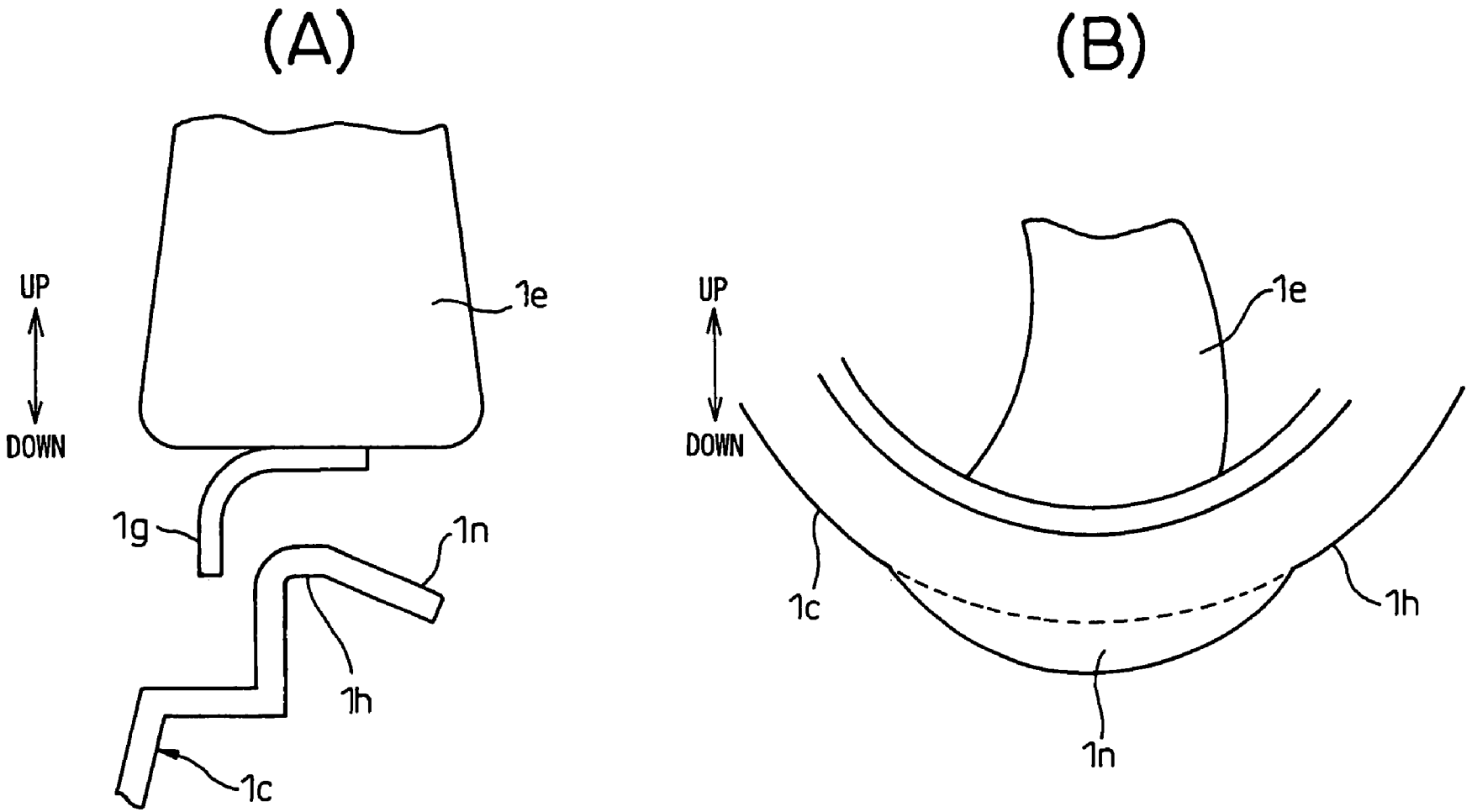
FIG. 3 is a drawing explaining the characteristics of a blower 1 according to a second embodiment of the present invention.

Though in the first embodiment, "the discharging water means" as set forth in claims is formed by the discharge port 1*m* that is a through-hole, in a second embodiment, as shown in FIG. 3(A), an inclined surface inclined with respect to the horizontal plane is provided at the lower side of the shroud 1*c* so that the discharging water means is formed.

In addition, in the present embodiment, as shown in FIG. 3(B), as the inclined surface in is provided within an area equal to or more than an area of the shroud extending to 20 degree points along the blade circumference in both directions (total 40 degree area) from the center which is the lowest portion of the shroud 1*c* when the vehicle stops in a horizontal state, therefore, even when the vehicle stops in an inclined state, it is possible to discharge the water drops without fail.

Third Embodiment

Figure 4:
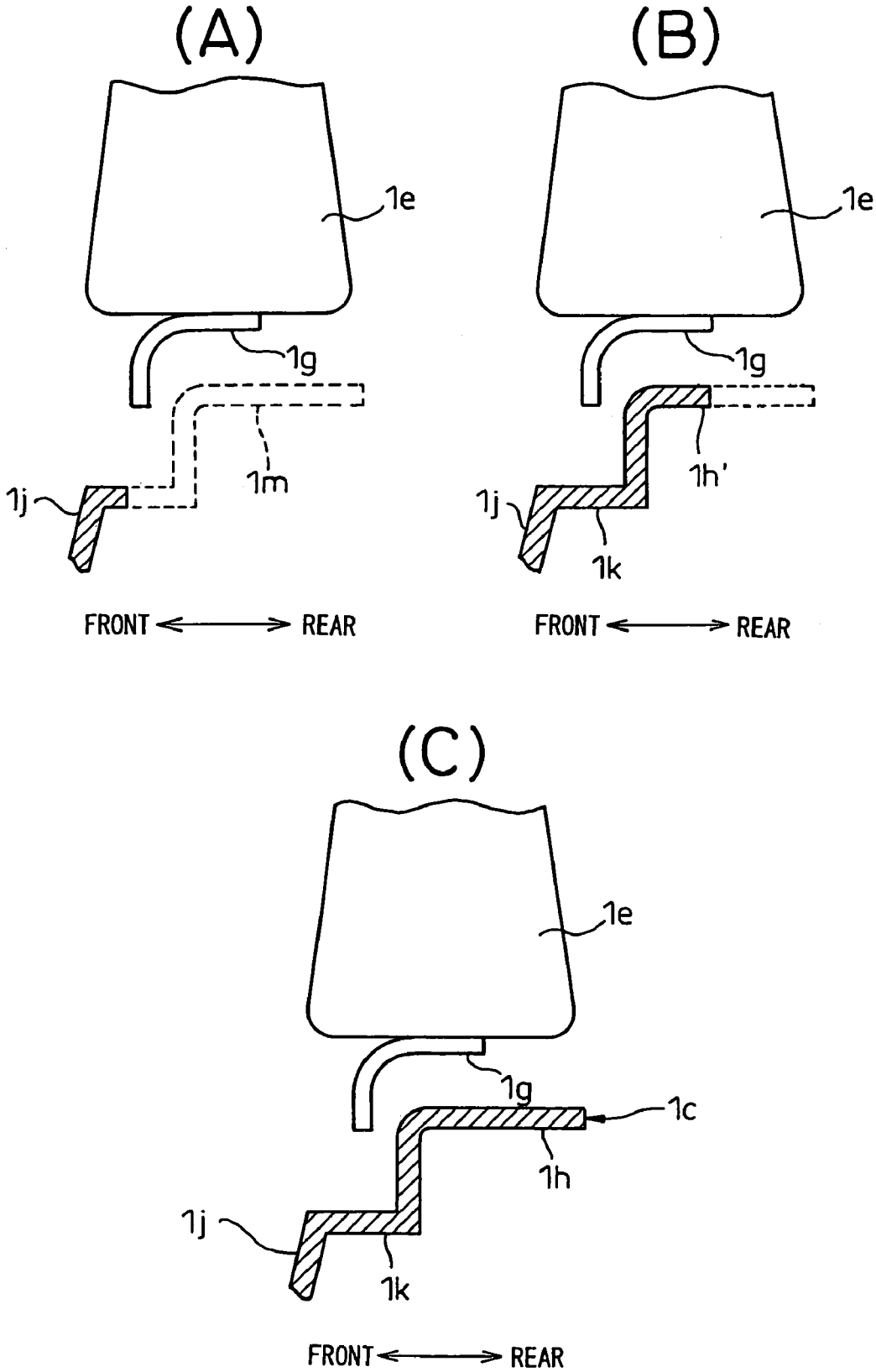
FIG. 4 is a drawing explaining the characteristics of a blower 1 according to a third embodiment of the present invention.

A third embodiment provides a structure wherein the height of the part of the ring portion 1*h* in the vicinity of the area in which the discharge port 1*m* is formed is lower than the other part of the ring portion 1*h*, as shown in FIG. 4.

As shown in FIG. 4(A), the portion of the ring portion 1*h* at the lowest side thereof is cut and thereby forms the discharge port 1*m*. In addition, as shown in FIG. 4(B), the height of the part of the ring portion 1*h*' included within an area equal to or more than an area of the shroud extending to 20 degree points along the blade circumference in both directions (total 40 degree area) from the center which is set at the lowest portion of the ring portion 1*h*, in the axial direction of the rotating shaft of the blower 1 is formed to be shorter than the height of the upper portion of the ring portion 1*h* shown in FIG. 4(C). In this construction, even in the vicinity of the discharge port 1*m*, it is possible to reduce the area in which the distance between the ring 1*g* or the blade 1*e* of the blade wheel 1*a* and the ring portion 1*h*' is small so that if a vehicle stops in an inclined state of the vehicle body it is possible to prevent the frozen lock phenomenon from occurring. Further, as the ring portion 1*h*' is formed it is possible to prevent the air supplying performance of the blade wheel 1*a* from being deteriorated.

Other Embodiments

In the above-mentioned embodiments, the blower according to the present invention is used for a heat exchanging device for a vehicle but the present invention may be applied to, for example, an outdoor unit for an air-conditioner (which is placed at the outside of a compartment), as the present invention is to prevent the freezing lock phenomenon by preventing water drops from being stored between the blade wheel 1*a* and the shroud 1*c*.

In the above-mentioned embodiments, the blower is an axial flow type but the present invention is not limited to the axial flow type blower.

In the above-mentioned embodiments, the blade wheel 1*a* is such a type that comprises the blades 1*e* provided with the ring 1*g* at the top ends thereof but the present invention is not limited to this type.

In addition, the discharge water means as set forth in claims is not limited to the discharge port 1*m* or the inclined surface 1*n* shown in the above-mentioned embodiments.

In the above-mentioned embodiments, the discharge water means are provided within an area equal to or more than an area of the shroud extending to 20 degree points along the blade circumference in both directions (total 40 degree area) from the center which is the lowest portion of the ring portion 1*h*. However, the present invention is not limited to this and it may be possible to provide the discharge water means within an area equal to or more than an area of the shroud extending to 10 degree points along the blade circumference in both directions (total 20 degree area) (for example, within an area equal to or more than an area of the shroud extending to 10 to 15 degree points along the blade circumference in both directions (total 20 to 30 degree area)) from the center of which is the lower end of the ring portion 1*h*.

The present invention may satisfy the concept of the present invention as set forth in claims and the present invention is not limited to the above-mentioned embodiments.

While the invention has been described by reference to specific embodiments chosen for the purposes of illustration, it should be apparent that numerous modifications could be made thereto by those skilled in the art without departing from the basic concept and scope of the invention.

The invention claimed is:

1. A blower comprising:

a blade wheel for producing air flow which is an axial flow type fan and in which air flows through the blade wheel in an axial direction of a rotating shaft of the blade wheel;

a driving source for rotating the blade wheel; and a stationary shroud surrounding an outer circumference of the blade wheel so as to cover it; and a ring formed in an annular shape so as to connect top ends of blades of the blade wheel and in which one end of the ring is extended toward the stationary shroud, wherein a discharge water opening area is opposed to the end of the ring for discharging water stored between the stationary shroud and the blade wheel is provided at a lower side of the stationary shroud to the axis of the blade wheel and on an annular ring portion of the stationary shroud; and the opening area is formed at a position opposite to the ring so that the opening area is opposed to a substantially entire area of a width of the ring.

2. The blower as set forth in claim 1, wherein the discharge water opening area comprises a through-hole penetrating through the annular ring portion.

3. The blower as set forth in claim 2, wherein the discharge water opening area is provided within a specific area of the stationary shroud in which a lowest portion of the annular ring portion is a center thereof.

4. The blower as set forth in claim 3, wherein the discharge water opening area is provided within an area equal to or more than an area of the shroud extending to 20 degree points along a blade circumference in both directions from a center which is a lowest portion of the annular ring portion.

5. The blower as set forth in claim 1, wherein the discharge water opening area comprises an inclined surface inclined with respect to a horizontal plane which is in parallel to the axial direction of the blade wheel.

6. The blower as set forth in claim 3, wherein the discharge water opening area is provided within an area equal to or more than an area of the shroud extending to 10 degree points along a blade circumference in both directions from a center which is a lowest portion of the annular ring portion.

7. The blower as set forth in claim 1, wherein the discharge water opening area is provided on a step portion of the annular ring portion having a step-like shape.

8. The blower as set forth in claim 7, wherein one surface of the step portion of the annular ring portion is substantially parallel to the axial direction of the blade wheel and overlapped with the end of the ring in a radial direction of the blade wheel.

9. The blower as set forth in claim 8, wherein the one side of the step portion is inclined with respect to a horizontal plane which is in parallel to the axial direction of the blade wheel.

10. A heat exchanging device for a vehicle comprises:

a heat exchanger mounted on a front end of the vehicle for effecting heat exchange with air; and a blower as set forth in claim 1, for supplying air to the heat exchanger.

11. The blower as set forth in claim 1, wherein a portion of the annular ring portion in a vicinity of the discharge water opening area has a length in the axial direction, which is shorter than that of the annular ring portion without the discharge water opening area.

* * * * *